US011195391B2

(12) United States Patent
Adolfsson

(10) Patent No.: US 11,195,391 B2
(45) Date of Patent: Dec. 7, 2021

(54) WEARABLE DISTRESS DEVICE

(71) Applicant: Designer Karolina Adolfsson, Stavanger (NO)

(72) Inventor: Anna Karolina Adolfsson, Stavanger (NO)

(73) Assignee: Designer Karolina Adolfsson, Stavanger (NO)

( * ) Notice: Subject to any disclaimer, the term of this patent is extended or adjusted under 35 U.S.C. 154(b) by 12 days.

(21) Appl. No.: 16/818,084

(22) Filed: Mar. 13, 2020

(65) Prior Publication Data

US 2021/0287499 A1 Sep. 16, 2021

(51) Int. Cl.
*G08B 5/40* (2006.01)
*G08B 25/01* (2006.01)

(52) U.S. Cl.
CPC ..... *G08B 5/40* (2013.01); *G08B 25/016* (2013.01)

(58) Field of Classification Search
CPC ..... G08B 5/40; G08B 25/016
USPC ..... 340/573.1
See application file for complete search history.

(56) References Cited

U.S. PATENT DOCUMENTS

2014/0111343 A1* 4/2014 Kim ..... G08B 17/10 340/628
2014/0338654 A1* 11/2014 Neff ..... F41H 9/06 126/263.02
2017/0365145 A1* 12/2017 Von Ehrenkrook . G08B 15/004
2019/0237447 A1* 8/2019 Dixon ..... H01L 25/13
2020/0221718 A1* 7/2020 Flood ..... A23B 4/052

* cited by examiner

*Primary Examiner* — Hirdepal Singh
(74) *Attorney, Agent, or Firm* — Vorys, Sater, Seymour & Pease

(57) ABSTRACT

A wearable distress device includes a smoke generating unit, an activation circuitry comprising a battery, a switch and a filament interconnected such that upon operation of the switch the filament is heated for igniting the smoke generating unit. The device further includes an enclosure comprising a smoke generating unit chamber configured to house the smoke generating unit and the filament, the smoke generating unit chamber having a smoke outlet wall formed by a portion of an outer wall of the enclosure, the smoke outlet wall comprises a material being heat reactive such that upon ignition of the smoke generating unit a smoke outlet is formed by burning and/or melting through the smoke outlet wall.

13 Claims, 3 Drawing Sheets

WEARABLE DISTRESS DEVICE

FIELD OF THE INVENTION

The present invention relates to a wearable distress device.

BACKGROUND ART

Smoke is a common type of signaling and has been used throughout time as means for communication. The oldest form om smoke signals are fires used to send information of news or danger etc. Smoke signals are still commonly used in distress situations having the aim of sending information about the location of the signal's origin, and to know that the user of the signal needs help and require immediate assistance.

However, smoke wearable distress devices need to be handled with care such as no not cause harm to user or surroundings, and so that the distress signal is sent out properly to give the broadest signal.

Therefore, there is room for improvements to the design of smoke distress signals.

SUMMARY OF THE INVENTION

In view of that stated above, the object of the present invention is to provide an improved wearable distress device. It is a further object to provide a wearable distress device that is simple to use and sends a proper distress signal, while having a low risk of harming a user of the wearable distress device.

To achieve at least one of the above objects and also other objects that will be evident from the following description, a wearable distress device is provided according to the present invention. Preferred embodiments of the device will be evident from the description.

According to a first aspect, there is provided a wearable distress device. The wearable distress device comprises a smoke generating unit, an activation circuitry comprising a battery, a switch and a filament interconnected such that upon operation of the switch the filament is heated for igniting the smoke generating unit, and an enclosure comprising a smoke generating unit chamber configured to house the smoke generating unit and the filament, the smoke generating unit chamber having a smoke outlet wall formed by a portion of an outer wall of the enclosure, the smoke outlet wall comprises a material being heat reactive such that upon ignition of the smoke generating unit a smoke outlet is formed by burning and/or melting through the smoke outlet wall.

By the term "smoke generating unit" is in this context meant a unit that is configured to generate smoke. Especially, to generate smoke upon being ignited. The smoke generating unit may be configured to generate smoke of a particular color, e.g. white, orange, blue, red, purple, etc. According to non-limiting examples the smoke generating unit may be a smoke pellet or a smoke cartridge. Smoke from the smoke generating unit may escape from the wearable distress device through the smoke outlet and thereby send a distress signal. The smoke generating unit may be configured to generate smoke through a self-sustained exothermic reaction.

By the term "filament" is in this context meant a unit that is configured to generate heat upon a current in running therethrough. The filament may be a Nichrome wire. The filament may be a Kanthal® wire. It is further understood that the filament does not need to be in the form of a wire. The filament may be in any suitable form, e.g. a wire or a pad, as long as the filament is configured to generate heat upon a current in running therethrough. Hence, upon operation of the switch in the activation circuitry a current is configured to run through the filament and heat is generated in the filament. The heat generated by the filament may ignite the smoke generating unit. Alternatively, the filament may be coated with an explosive ignition substance, e.g. pyrogen. An example of such an ignition arrangement is a so-called electric match. Hence, the filament may activate the explosive ignition substance igniting the smoke generating unit.

Heat generated by the filament, the electric match and/or heat generated by the smoke generation unit may burn a hole and/or melt the smoke outlet wall such that the smoke outlet is formed. Upon the smoke outlet being formed, smoke generated by the smoke generating unit may be released from the wearable distress device.

Accordingly, a distress smoke signal is achieved in a simple manner. The improved distress smoke signal may be achieved by one action of activating the wearable distress device. The enclosure may protect the smoke generating unit from being damp. Further, the enclosure may protect the user of the wearable distress device from being hurt by the ignited smoke generating unit. By housing the smoke generating unit in the smoke generating unit chamber generated smoke may be concentrated therein before it is released from the wearable distress device. Further, by housing the smoke generating unit in the smoke generating unit chamber the smoke generating unit may be held in place relative the filament increasing the reliability of the wearable distress device.

The present wearable distress device may hence be easy to handle, providing an easy and quick activation. The wearable distress device may be worn on the body, e.g. an arm, using a strap. This facilitate use of the wearable distress device. The wearable distress device may be worn during different types of activities without occupying the user's hands. Wearing the wearable distress device on the body makes it easy to access in case of need for activation. Further wearing the wearable distress device on the body provide for handsfree usage, i.e. upon activation the user may have the hands free for other activities such as holding tight to something. Additionally, the wearable distress device is not explosive. Hence, it may be worn on the body with minimal risk of injuring the user.

The smoke outlet wall may be a weaker sacrificial portion of the outer wall of the enclosure as it will be burnt or melted during activation of the wearable distress device.

The smoke outlet wall may be made of a polymeric material. The polymeric material may be a plastic material. The polymeric material may be a thermoplastic material. The polymeric material may be beneficial to use since it often has a relatively low melting point. Hence, efficient release of smoke may be ensured.

The smoke outlet wall may comprise a first portion and a second portion. A wall thickness of the first portion may be thinner than a wall thickness of the second portion. By such a configuration, the first portion may form the smoke outlet and the second portion may stay intact during activation of the wearable distress device. As such, the release of the smoke from the wearable distress device may be concentrated to a desired area of the enclosure. Hence, the risk of harm to a user from the generated heat may be reduced.

The second portion of the smoke outlet wall may comprise a reinforcement. The reinforcement may be made from glass fiber. The reinforcement of the second portion may further reduce the risk of the second portion of the smoke outlet wall burning through, thereby, the risk of causing a user harm due to the heat provided may further be reduced.

The first portion of the smoke outlet wall may be formed by an indentation on an inside of the outer wall of the enclosure. Thereby a smooth outer surface of the wearable distress device may be provided.

The wearable distress device may further comprise a pad arranged in the indentation. The filament may be arranged between the pad and the smoke generating unit. The pad may be made of a cotton material. The pad may be arranged to press the filament towards the smoke generating unit. By this arrangement ignition of the smoke generating unit may be facilitated. As such, the efficiency of the activation of the wearable distress device may be improved.

The filament may be arranged to abut the smoke generating unit. By such a configuration, the ignition of the smoke generating unit may be improved.

The wearable distress device may comprise a compressible pad arranged between a bottom wall of the smoke generating unit chamber and the smoke generating unit. In such a configuration the bottom wall of the smoke generating unit chamber is opposite the smoke outlet wall. The compressible pad may be made of a cardboard material. The cardboard material may be a corrugated cardboard. The compressible pad may allow for a size variance of the smoke generating unit. The compressible pad may provide isolation between a bottom part of the wearable distress device, thereby a user may be protected from heat transferring out of the device through the bottom. As such, a too small smoke generating unit may be arranged to abut the compressible pad. A perfectly sized smoke generating unit may be arranged to slightly compress the compressible pad. A too large smoke generating unit may be accordingly be arranged to compress the compressible pad far enough to fit the smoke generating unit. For all the above configurations of smoke generating unit the compressible pad may safeguarded that the smoke generating unit and the filament are abutting.

The enclosure may further comprise a push button configured to upon being pushed operate the switch of the activation circuitry. The push button may facilitate the activation of the wearable distress device. The push button may be mechanically connected to the switch of the activation circuitry.

The smoke generating unit chamber may be configured to tightly house the smoke generating unit. By tightly housing the smoke generating unit, the enclosure may be manufactured with a smaller size, and thus a simpler to carry and use wearable distress device may be achieved. By a tight housing of the smoke generating unit, heat may be concentrated towards areas where heat is desired, being the smoke outlet wall and the smoke generating unit. Hence a more efficient distress signal may be sent using the wearable distress device.

The enclosure may further comprise a battery chamber configured to house the battery. The battery chamber and the smoke generating unit chamber may be separate chambers. Such a configuration may prevent smoke spreading within the device.

The enclosure may comprise a top part and a bottom part. The top and bottom part of the enclosure may be sealingly connected to each other. The top part and the bottom part may be welded together. The top part and the bottom part may be sealingly connected such as to be water resistant.

The bottom part may comprise a first smoke generating unit holding structure having a bottom portion and a wall portion (erecting from the bottom portion). The top part may comprise a second smoke generating unit holding structure having a top portion and a wall portion (erecting from the bottom portion). The first and second smoke generating unit holding structures may together form the smoke generating unit chamber.

The top portion of the top part may comprise the portion of the outer wall of the enclosure forming the smoke outlet wall.

The smoke generating unit chamber may be cylindrical, preferably circular cylindrical. With such a configuration, a smoke pellet may be fitted into the smoke generating unit chamber.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DESCRIPTION OF EMBODIMENTS

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

It will be appreciated that the present invention is not limited to the embodiments shown. Several modifications and variations are thus conceivable within the scope of the invention which thus is exclusively defined by the appended claims.

With reference to FIGS. 1-4 a wearable distress device 100 will now be described. The wearable distress device 100 comprises a smoke generating unit 102, an activation circuitry 104 and an enclosure 106. In assembled form, see FIG. 1, the smoke generating unit 102 and the activation circuitry 104 are enclosed by the enclosure 106.

Figure 1:
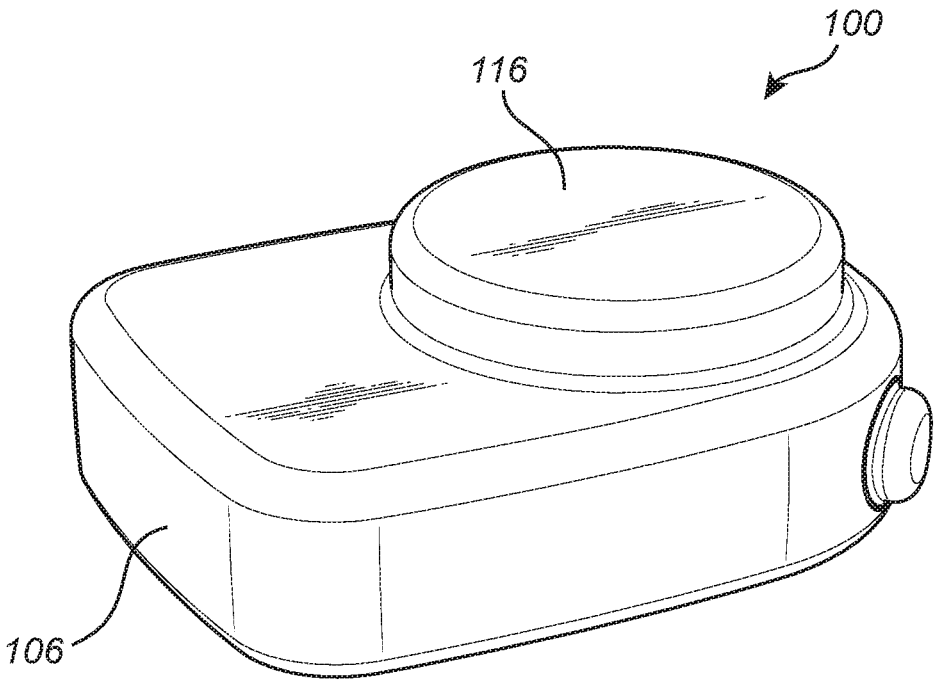
FIG. 1 illustrates a wearable distress device in assembled form.
Figure 2:
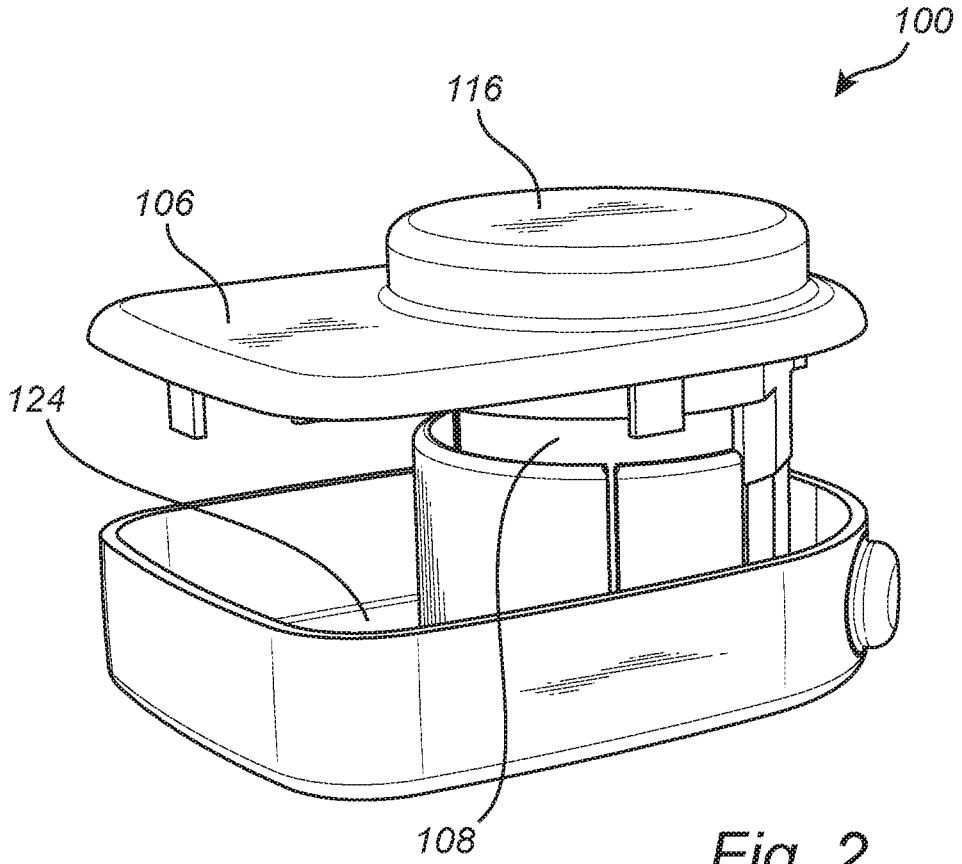
FIG. 2 illustrates a partly exploded view of the wearable distress device of FIG. 1.
Figure 3:
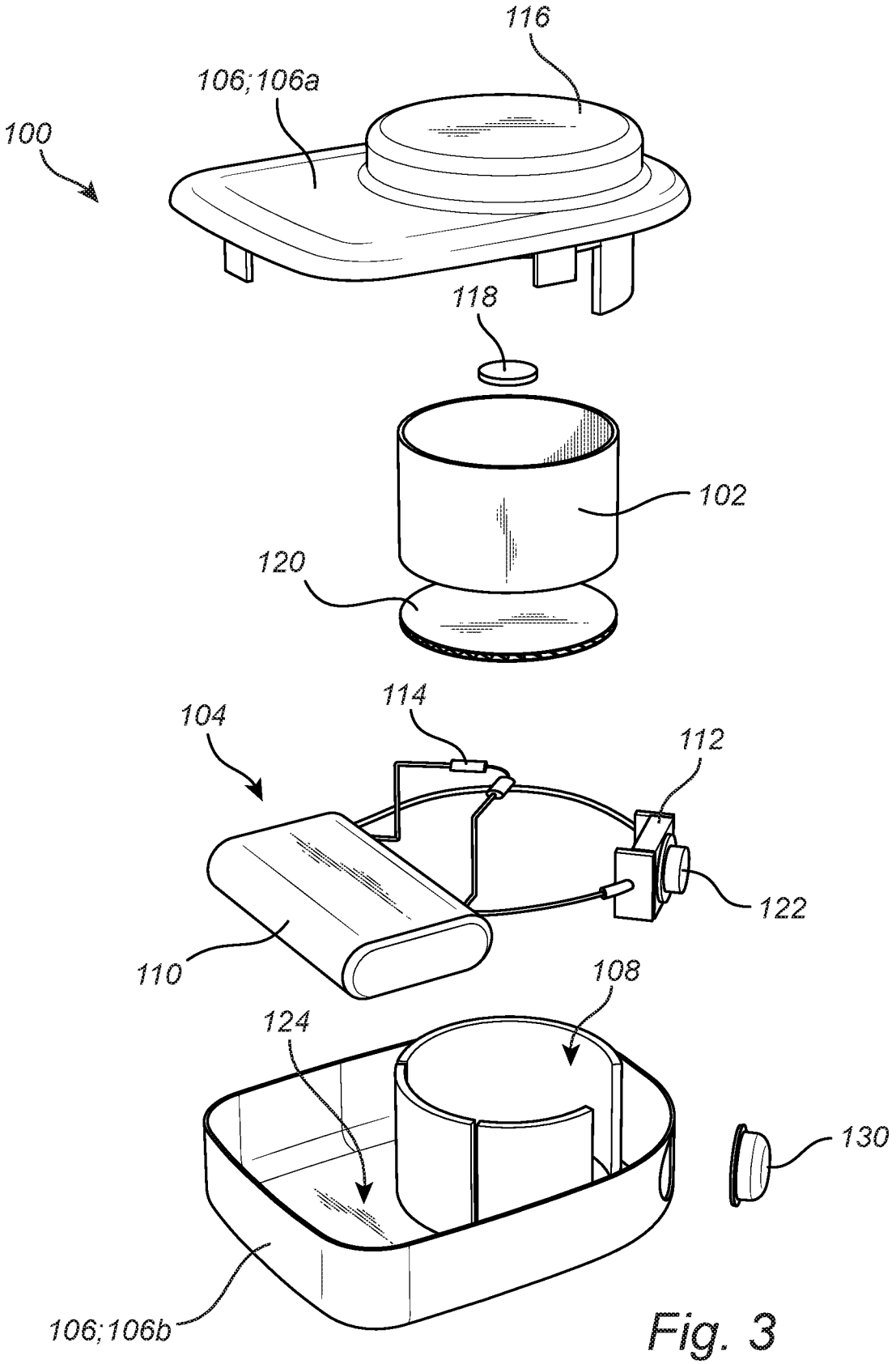
FIG. 3 illustrates an exploded view of a wearable distress device.

The activation circuitry 104 comprises a battery 110, a switch 112 and a filament 114, see FIG. 3. The battery 110 may be any type of battery configured to store electrical energy. For example, the battery may be an alkaline battery, a lithium-metal battery, a lithium-ion battery or a nickel cadmium battery. The battery 110 may be a rechargeable battery. The switch 112 may be a mechanical switch. The components of the activation circuitry 104 are interconnected such that upon operation of the switch 112 a current is running through the filament 114. Upon the current is running through the filament 144 heat is generated. The generated heat is then igniting the smoke generating unit 102. Hence, upon operating the switch the wearable distress device 100 is activated by igniting the smoke generating unit 102.

The enclosure 106 comprises a smoke generating unit chamber 108 configured to house the smoke generating unit 102 and the filament 114. The smoke generating unit chamber 108 has a smoke outlet wall 116 being formed by a portion of an outer wall of the enclosure 106. The smoke outlet wall 116 comprises a material being heat reactive such that upon ignition of the smoke generating unit 102 a smoke outlet is formed by burning and/or melting through the smoke outlet wall 116.

The filament 114 may be arranged to abut the smoke generating unit 102. By the smoke generating unit 102 and the filament abutting each other ignition of the smoke generating unit 102 may be facilitated. Further, the time for igniting the smoke generating unit 102 may be reduced. By a quicker heat and smoke generation within the wearable distress device 100 the time between activation of the activation circuitry 104 and the formation of the smoke outlet may be reduced. Such a configuration may provide a wearable distress device that is simple to use, and that has a low activation time.

The filament 114 may be a nichrome wire. The filament 114 may be a Kanthal® wire. The filament 114 may be arranged to be burnt off after activation thereof. By the filament 114 being burnt off, there is no need for the wearable distress device 100 to be turned off, this will happen automatically. Thereby a safe to use wearable distress device 100 may be provided.

The filament 114 may be coated with an explosive ignition substance, e.g. pyrogen. An example of such an ignition arrangement is a so-called electric match. Hence, the filament 114 may activate the explosive ignition substance igniting the smoke generating unit 102.

The smoke outlet wall 116 may be made of a polymeric material. The enclosure 106 may be made of a polymeric material. The polymeric material may be a plastic material. The plastic material may be a thermoplastic material. The thermoplastic material may be made from renewable resources such as for example starch, cellulose or vegetable oils. The thermoplastic material may be made from petroleum. By the smoke outlet wall 116 being made of a polymeric material, the time for the smoke outlet to form may be reduced. Such a configuration may prevent any other part of the enclosure 106 from burning through during activation of the wearable distress device 100. Accordingly, a safe to use, and a simple to use wearable distress device 100 may be achieved. Alternatively, the smoke outlet wall may be made of a paper-based material. Such a paper-based material may be molded pulp or waxed cardboard.

Figure 4:
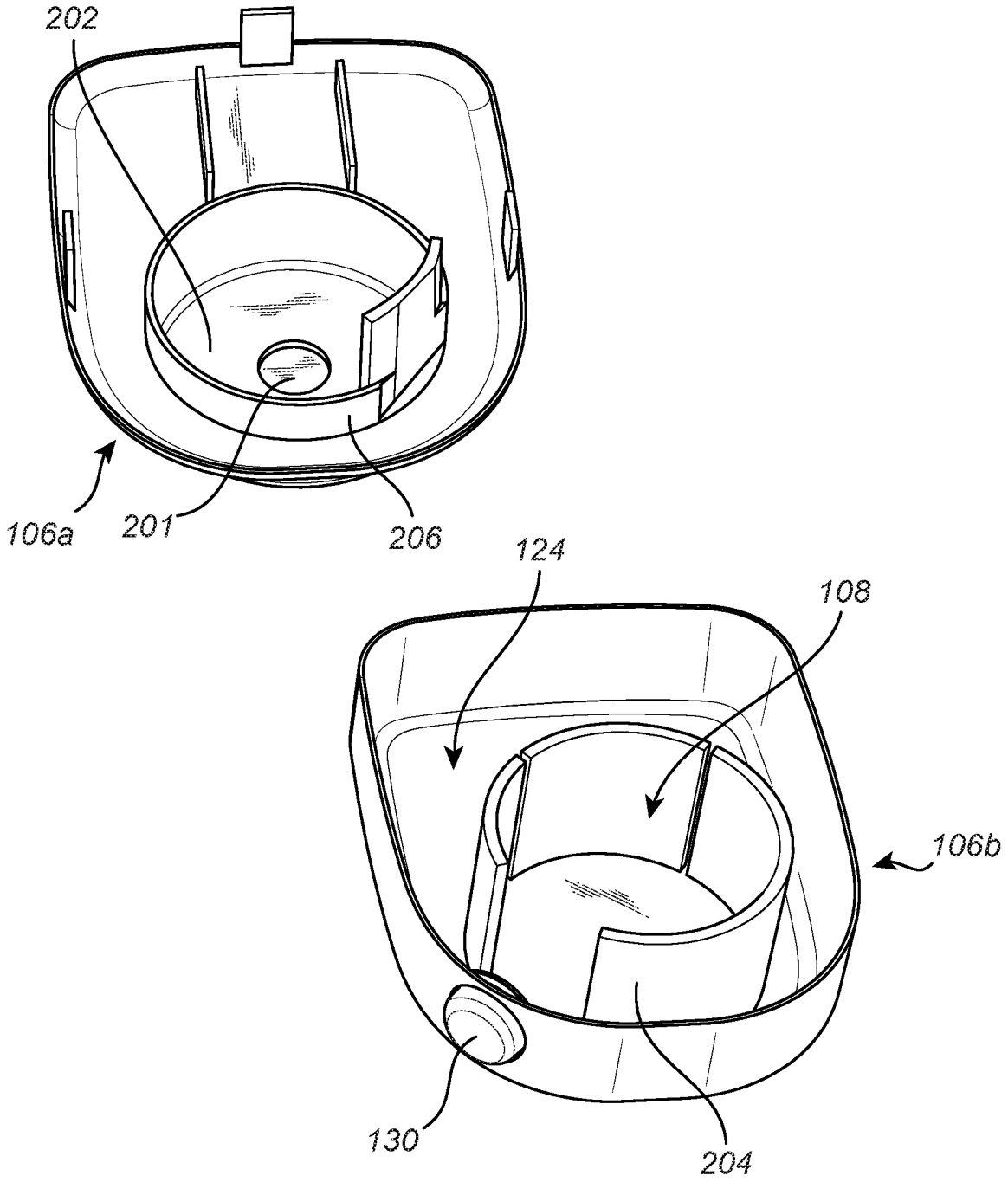
FIG. 4 illustrates an enclosure of the wearable distress device having a top part and a bottom part.

As is shown in FIG. 4, the smoke outlet wall 116 may comprise a first portion 201 and a second portion 202. A wall thickness of the first portion 201 is thinner than a wall thickness of the second portion. As such, the first portion 201 may be burnt through during activation of the filament 114, while the second portion 202 remains substantially intact. Accordingly, a safe to use, and a simple to use wearable distress device 100 may be achieved.

The second portion 202 of the smoke outlet wall 116 may comprise a reinforcement. The reinforcement may prevent the second portion 202 from being melted or burnt through. The reinforcement may be a glass fiber reinforcement. The reinforcement may be attached to the smoke outlet wall 116. Alternatively, or in combination, the reinforcement may be placed as a separate portion of the wearable distress device 100 in between the smoke outlet wall 116 and the smoke generating unit 102. Alternatively, or in combination, the reinforcement may be attached to the smoke generating unit 102.

The first portion 201 of the smoke outlet wall 116 may be formed by an indentation on an inside of the outer wall of the enclosure 106. The wearable distress device 100 may further comprise a pad 118 arranged in the indentation. The filament 114 may in such configuration be arranged between the pad 118 and the smoke generating unit 102. The pad 118 may be made of a cotton material.

The pad 118 may provide the filament 114 with a force pressing the filament 114 towards the smoke generating unit. As such, the pad 118 may provide a quicker activation of the wearable distress device 100.

The wearable distress device 100 may further comprise a compressible pad 120. The compressible pad 120 may be arranged between a bottom wall of the smoke generating unit chamber 108 and the smoke generating unit 102. The bottom wall of the smoke generating unit chamber 108 is opposite to the smoke outlet wall 116 of the enclosure. The compressible pad 120 may be made of a cardboard material. The compressible pad 120 is preferably made from corrugated cardboard. The compressible pad 120 is compressed to fit the smoke generating unit 102 in the smoke generating unit chamber 108. Thereby a variance of size of the smoke generating unit 102 will not render a play inside the smoke generating unit chamber 108. Hence, a good contact between the filament 114 and the smoke generating unit 102 may be safeguarded.

The smoke generating unit chamber 108 may be configured to tightly house the smoke generating unit 102. Thereby play between the components in the smoke generating unit chamber 108 may be reduced.

The enclosure 106 of the wearable distress device 100 may comprise a push button 122. The push button 122 may be configured to upon being pushed operate the switch 112 of the activation circuitry 104. Thus, the push button 122 may be configured to upon being pushed activate the wearable distress device 100. The push button 122 may be formed by an over-molded button 130 watertight seal.

The wearable distress device 100 may further comprise a battery chamber 124. The battery chamber 124 may be configured to house the battery 110. The battery chamber 124 and the smoke generating unit chamber 108 may be separate chambers.

The enclosure 106 may comprise a top part **106*a* and a bottom part 106*b* sealingly connected to each other. The top and bottom part 106*a*, 106*b* of the enclosure 106 may be sealingly connected through welding. It is preferred that the sealingly connection between the top part 106*a* and the bottom part 106*b* is water resistant. It is most preferred that the sealingly connection between the top part 106*a* and the bottom part 106*b* is waterproof. Such a configuration may prevent the smoke generating unit 102 from getting damp and thereby being harmed. Accordingly, an efficient wearable distress device 100** may be achieved.

As evident from FIG. 4, the bottom part **106*b* of the enclosure may comprise a first smoke generating unit holding structure 204. The first smoke generating unit holding structure 204 has a bottom portion and a wall portion erecting from the bottom portion. The top part 106***a* may comprise a second smoke generating unit holding structure 206. The second smoke generating unit holding structure 206 has a top portion and a wall portion erecting from the bottom portion.

The smoke generating unit chamber 108 may be cylindrical, preferably circular cylindrical.

The first smoke generating unit holding structure 204 may comprise one or more recesses, wherein a wire of the activation circuitry 104 may be fitted.

When the top part 106*a* and the bottom part 106*b* are assembled together, the first and second smoke generating unit holding structures 204, 206 together form the smoke generating unit chamber 108.

The top portion of the top part 106*a* may comprise the portion of the outer wall of the enclosure 106 forming the smoke outlet wall 116.

The person skilled in the art realizes that the present invention by no means is limited to the preferred embodiments described above. On the contrary, many modifications and variations are possible within the scope of the appended claims.

For example, the wearable distress device 100 may comprise a warning circuitry configured to send a signal upon the voltage in the battery 110 being below a predetermined threshold. Such a signal may be a sound signal, a light signal, a vibration signal etc.

The wearable distress device 100 may comprise a distress signal emitter. The distress signal emitter may be configured to emit a distress signal in the form of a radio signal. The distress signal emitter may send out the distress signal upon activation of the wearable distress device 100. The distress signal may comprise information pertaining to a geographical position of the wearable distress device 100. Hence, the wearable distress device 100 may comprise a positioning unit configured to determine a present geographical position of the wearable distress device 100. Alternatively, or in combination, the distress signal may comprise an indication that the user of the wearable distress device 100 needs help. The distress signal may be in the form of an SMS directed towards one or more preset receivers of the distress signal. The distress signal emitter may further be configured to transmit the distress signal to mobile phones in the vicinity of the wearable distress device 100.

The wearable distress device 100 may comprise a communication unit. The communication unit being configured to interconnect the wearable distress device 100 with an electronic device such as a mobile phone, a laptop, a tablet, etc. The signal indicating low voltage in the battery may be sent to the electronic device via the communication unit.

The wearable distress device 100 may comprise a microcontroller. The microcontroller being configured to control the activation circuitry 104, the warning circuitry, the distress signal emitter and/or the communication unit. For example, activation of the wearable distress device 100 may be made by sending an activation signal from an electronic device being in communication with the wearable distress device 100 via the communication unit. Then the microcontroller is operating the switch 112 for igniting the smoke generating unit 102.

The wearable distress device 100 may be arranged to be carried by a user in an arm band, or a pouch comprising a clip, etc.

The Reinforcement

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A wearable distress device comprising:

a smoke generating unit, an activation circuitry comprising a battery, a switch and a filament interconnected such that upon operation of the switch the filament is heated for igniting the smoke generating unit, and an enclosure comprising a smoke generating unit chamber configured to house the smoke generating unit and the filament, the smoke generating unit chamber having a smoke outlet wall formed by a portion of an outer wall of the enclosure, the smoke outlet wall comprises a material being heat reactive such that upon ignition of the smoke generating unit a smoke outlet is formed by burning and/or melting through the smoke outlet wall, wherein the smoke outlet wall is made of a polymeric material.

2. The wearable distress device according to claim 1, wherein the filament is arranged to abut the smoke generating unit.

3. The wearable distress device according to claim 1, wherein the enclosure further comprises a push button configured to upon being pushed operate the switch of the activation circuitry.

4. The wearable distress device according to claim 1, wherein the smoke generating unit chamber is configured to tightly house the smoke generating unit.

5. The wearable distress device according to claim 1, wherein the enclosure further comprises a battery chamber configured to house the battery, wherein the battery chamber and the smoke generating unit chamber are separate chambers.

6. The wearable distress device according to claim 1, wherein the enclosure comprises a top part and a bottom part sealingly connected to each other.

7. The wearable distress device according to claim 1, wherein the smoke generating unit chamber is cylindrical, preferably circular cylindrical.

8. A wearable distress device comprising:

a smoke generating unit, an activation circuitry comprising a battery, a switch and a filament interconnected such that upon operation of the switch the filament is heated for igniting the smoke generating unit, and an enclosure comprising a smoke generating unit chamber configured to house the smoke generating unit and the filament, the smoke generating unit chamber having a smoke outlet wall formed by a portion of an outer wall of the enclosure, the smoke outlet wall comprises a material being heat reactive such that upon ignition of the smoke generating unit a smoke outlet is formed by burning and/or melting through the smoke outlet wall, wherein the smoke outlet wall comprises a first portion and a second portion wherein a wall thickness of the first portion is thinner than a wall thickness of the second portion.

9. The wearable distress device according to claim 8, wherein the second portion of the smoke outlet wall comprises a reinforcement, preferably a glass fiber reinforcement.

10. The wearable distress device according to claim 8, wherein the first portion of the smoke outlet wall is formed by an indentation on an inside of the outer wall of the enclosure, and wherein the wearable distress device further comprises a pad arranged in the indentation, and wherein the filament is arranged between the pad and the smoke generating unit.

11. A wearable distress device comprising:

a smoke generating unit, an activation circuitry comprising a battery, a switch and a filament interconnected such that upon operation of the switch the filament is heated for igniting the smoke generating unit, and an enclosure comprising a smoke generating unit chamber configured to house the smoke generating unit and the filament, the smoke generating unit chamber having a smoke outlet wall formed by a portion of an outer wall of the enclosure, the smoke outlet wall comprises a material being heat reactive such that upon ignition of the smoke generating unit a smoke outlet is formed by burning and/or melting through the smoke outlet wall, wherein the wearable distress device further comprises a compressible pad arranged between a bottom wall of the smoke generating unit chamber and the smoke generating unit.

12. A wearable distress device comprising:

a smoke generating unit, an activation circuitry comprising a battery, a switch and a filament interconnected such that upon operation of the switch the filament is heated for igniting the smoke generating unit, and an enclosure comprising a smoke generating unit chamber configured to house the smoke generating unit and the filament, the smoke generating unit chamber having a smoke outlet wall formed by a portion of an outer wall of the enclosure, the smoke outlet wall comprises a material being heat reactive such that upon ignition of the smoke generating unit a smoke outlet is formed by burning and/or melting through the smoke outlet wall, wherein the enclosure comprises a top part and a bottom part sealingly connected to each other, wherein the bottom part comprises a first smoke generating unit holding structure having a bottom portion and a wall portion erecting from the bottom portion, and wherein the top part comprises a second smoke generating unit holding structure having a top portion and a wall portion erecting from the bottom portion, wherein the first and second smoke generating unit holding structures together form the smoke generating unit chamber.

13. The wearable distress device according to claim 12, wherein the top portion of the top part comprises the portion of the outer wall of the enclosure forming the smoke outlet wall.

* * * * *